US011952885B2

(12) United States Patent
Al-Huwaider et al.

(10) Patent No.: US 11,952,885 B2
(45) Date of Patent: Apr. 9, 2024

(54) CLEANING A PRODUCTION LOGGING SPINNER FLOWMETER

(71) Applicant: Saudi Arabian Oil Company, Dhahran (SA)

(72) Inventors: Mustafa A. Al-Huwaider, Dhahran (SA); Shouxiang Mark Ma, Dhahran (SA); Salem H. Suwadi, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/832,024

(22) Filed: Jun. 3, 2022

(65) Prior Publication Data

US 2023/0392494 A1 Dec. 7, 2023

(51) Int. Cl.

| | |
|---|---|
| ***E21B 49/08*** | (2006.01) |
| ***E21B 36/04*** | (2006.01) |
| ***E21B 47/10*** | (2012.01) |

(52) U.S. Cl.

CPC ..... *E21B 47/10* (2013.01); *E21B 36/04* (2013.01); *E21B 49/0875* (2020.05)

(58) Field of Classification Search

CPC ..... E21B 47/10; E21B 49/0875; E21B 36/04

See application file for complete search history.

(56) References Cited

U.S. PATENT DOCUMENTS

| | | | | |
|---|---|---|---|---|
| 2,757,739 A | | 8/1956 | Douglas et al. | |
| 3,630,078 A | * | 12/1971 | Bonnet | E21B 47/10 73/152.35 |
| 3,954,006 A | * | 5/1976 | Anderson | E21B 47/10 73/152.34 |
| 4,033,187 A | * | 7/1977 | Nicolas | E21B 47/10 73/152.36 |
| 4,345,480 A | | 8/1982 | Basham et al. | |
| 4,581,926 A | * | 4/1986 | Moore | E21B 49/08 73/32 R |
| 4,827,765 A | | 5/1989 | Kessler | |
| 6,692,535 B2 | | 2/2004 | Olivier | |
| 6,854,342 B2 | | 2/2005 | Payne et al. | |
| 7,032,658 B2 | | 5/2006 | Chitwood et al. | |

OTHER PUBLICATIONS mech4study.com [online], "Electromagnetic clutch: Principle, working, advantages and disadvantages with its diagram," Oct. 2017, retrieved on May 10, 2022, retrieved from URL <https://www.mech4study.com/2017/10/electromagnetic-clutch-principle-working-advantages-and-disadvantages-with-diagram.html>, 6 pages.

* cited by examiner

*Primary Examiner* — D. Andrews

(74) *Attorney, Agent, or Firm* — Fish & Richardson P.C.

(57) ABSTRACT

A production logging tool has a housing, a flowmeter assembly, a heating element, a drive, a clutch, and a controller. The housing has a first end attached to a wellbore string. The flowmeter assembly has a spinner exposed to fluid in the production string and a spinner shaft fixed to the spinner and extending from a rear surface of the spinner into the housing. The spinner shaft is rotatably attached to the housing. The heating element is attached to the spinner. The drive is disposed within the housing. The controller is operationally coupled to the drive and the heating element. The controller activates and deactivates at least one of the drive or the heating element to heat a volume around the spinner with the heating element or selectively spin the spinner with the drive.

20 Claims, 6 Drawing Sheets

CLEANING A PRODUCTION LOGGING SPINNER FLOWMETER

FIELD OF THE DISCLOSURE

This disclosure relates to wellbore equipment, and more particularly to production logging spinner flowmeters.

BACKGROUND OF THE DISCLOSURE

Production logging operations include monitoring a wellbore to evaluate fluid movement in and out of a wellbore, quantify flow rates and flow profiles along a wellbore, determine fluid properties within a wellbore, and determine other fluid and wellbore parameters. Production logging often employs production-logging tools such as spinner flowmeters. Methods and equipment to improve production-logging operations are sought.

SUMMARY

Implementations of the present disclosure include a production logging tool that has a housing, a flowmeter assembly, a heating element, a drive, a clutch, and a controller. The housing has a first end attached to a wellbore string that runs the housing along a production string disposed within a wellbore. The flowmeter assembly has a spinner and a spinner shaft. The spinner is exposed to fluid in the production string. The spinner shaft is fixed to the spinner and it extends from a rear surface of the spinner into the housing. The spinner shaft is rotatably attached to a second end of the housing opposite the first end. The heating element is attached to the spinner. The drive is disposed within the housing. The clutch includes a rotor attached to the drive and an armature attached to the spinner shaft. The clutch is activated with or after activation of the drive. The controller is operationally coupled to the drive and the heating element. The controller activates and deactivates at least one of the drive or the heating element to heat a volume around the spinner with the heating element or selectively spin the spinner with the drive.

In some implementations, the production logging tool further includes a receiver communicatively coupled to the flow meter assembly and it receives, from the flowmeter assembly, information that includes at least one parameter of the fluid in the wellbore. In some implementations, the production logging tool also includes a processor communicatively coupled to the receiver. The processor receives the information from the receiver, compares the information to a fluid parameter threshold, determines that at least one of a sensitivity or performance of the flowmeter assembly is impaired, and transmit, based on the determination, instructions to the controller to activate at least one of the drive or the heating element.

In some implementations, the heating element rotates with the spinner. The heating element is electrically coupled, through an electrical slip ring, to a cable that electrically connects the controller to the heating element.

In some implementations, the receiver resides at or near a terranean surface of the wellbore. The receiver transmits the information to an interface device that displays the information for an operator to determine, based on the information, whether to activate at least one of the drive or the heating element.

In some implementations, the heating element has an electric heating element fixed to a front surface of the spinner opposite the rear surface of the spinner to rotate with the spinner.

In some implementations, the production logging tool also has a centralizer attached to the second end of the housing. The spinner has a fullbore spinner caged within the centralizer.

In some implementations, the rotor engages, upon activation of the drive, the armature to spin the spinner shaft with the drive. The rotor disengages, upon deactivation of the drive, the armature to allow free rotation of the spinner.

In some implementations, the clutch includes an electromagnetic clutch, and the controller activates the drive by transmitting electricity to an electrical winding of the rotor to generate a magnetic field and attract the armature toward the rotor to allow the rotor to engage the armature.

Implementations of the present disclosure also include a wellbore tool that has a housing, a flowmeter, a cleaning assembly, and a controller. The housing is attached to a wellbore string that runs or moves the housing along a wellbore. The flowmeter assembly is rotatably coupled to the housing. The flowmeter assembly has a first portion that includes spinner exposed to a wellbore fluid, and a second portion attached to the spinner and extending into the housing. The cleaning assembly is coupled to the flowmeter assembly. The cleaning assembly either heats a space near the spinner or selectively rotates the spinner or both. The controller is operationally coupled to the cleaning assembly. The controller activates and deactivates the cleaning assembly to heat a volume around the spinner or rotate the spinner or both.

In some implementations, the cleaning assembly has a heating element, a drive, and a clutch. The heating element is fixed to the spinner. The drive is disposed within the housing and is fluidly decoupled from the wellbore fluid. The clutch resides between the drive and the flowmeter assembly. The clutch is activated upon activation of the drive to allow the drive to engage and rotate the spinner. The controller is operationally coupled to the drive and the heating element. The controller activates and/or deactivates the drive or the heating element or both.

In some implementations, the heating element rotates with the spinner. The heating element is electrically coupled, through a rotatable electrical connection, to a cable that electrically connects the controller to the heating element.

In some implementations, the clutch has an electromagnetic clutch that has a rotor attached to the drive and an armature attached to the flowmeter assembly. The rotor engages the armature to rotate the armature upon activation of the drive.

In some implementations, the wellbore tool also includes a receiver communicatively coupled to the flow meter assembly and it receives, from the flowmeter assembly, information including at least one parameter of the fluid in the wellbore.

In some implementations, the wellbore tool also includes a processor communicatively coupled to the receiver. The processor receives the information from the receiver, compares the information to a fluid parameter threshold, determines, based on the comparison, that at least one of a sensitivity or performance of the flowmeter assembly is impaired, and transmits, based on the determination, instructions to the controller to activate the cleaning assembly.

In some implementations, the wellbore tool also includes a centralizer attached to a downhole end of the housing. The spinner is a full bore spinner caged within the centralizer.

Implementations of the present disclosure also include a method of logging and cleaning a logging tool. The method includes receiving, by a processing device and from a flowmeter assembly communicatively coupled to the processing device, first information including at least one parameter of a spinner of the flowmeter assembly. The method also includes comparing, by the processing device, the first information to a threshold. The method also includes determining, by the processing device and based on the comparison, that the at least one parameter of the spinner satisfies the threshold. The method also include determining, by the processing device and based at least on the determination that at least one parameter of the spinner satisfies the threshold, second information including instructions to activate a cleaning assembly coupled to the flowmeter assembly. The method also includes transmitting, by the processing device and to a controller, the second information to prompt the controller to activate the cleaning assembly.

In some implementations, determining the second information includes determining the second information based on wellbore history and third information received from one or more sensors disposed within the wellbore.

In some implementations, the at least one parameter includes a change of rotational speed of the spinner and the threshold includes a change of rotational speed threshold, and determining that the at least one parameter of the spinner satisfies the threshold includes determining that the change of rotational speed of the spinner is above the threshold.

In some implementations, the cleaning assembly includes a heating element fixed to the spinner, a drive disposed within a tube housing at least part of the flowmeter assembly, and a clutch residing between the drive and the flowmeter assembly. The clutch is activated upon activation of the drive to allow the drive to engage and rotate the spinner. Transmitting the second information to the controller includes transmitting the second information to prompt the controller to activate at least one of the heating element or the drive.

DETAILED DESCRIPTION OF THE DISCLOSURE

The present disclosure relates a production logging tool that has a cleaning assembly to clean a spinner flowmeter of the production logging tool. The performance of the production logging tool may be impaired by sticky materials such as tar or wax, which are often mixed with sand, rocks, and other downhole debris. These sticky materials tend to stick to the delicate spinners of the logging tool, which impair their sensitivity and performance of the tool. Sometimes, the sticky materials stall the spinner altogether, making it difficult to measure any downhole fluid velocity and causes operational failures and downtimes. The issue is most common in horizontal wells where the tool is usually scrubbing/agitating the borehole floor deposits while moving during logging passes. The cleaning assembly includes an electric motor, a rotor shaft, a clutch, and a heater. The cleaning assembly is activated from a surface of the wellbore to clean the production logging tool and thus allow the production logging tool to perform as intended to allow the accurate measurement of fluid parameters of the wellbore.

Particular implementations of the subject matter described in this specification can be implemented so as to realize one or more of the following advantages. For example, the cleaning assembly allows the production logging tool to be cleaned without having to pull the tool out of the wellbore, which can help save time and resources. In addition, because of the cleaning is in situ and can be automatic, logging runs before and after cleaning can be used as a way of data quality control of the logged data, which may be difficult or impossible to do with traditional flow meters that need to be pulled out to clean the flow meter.

Figure 1:
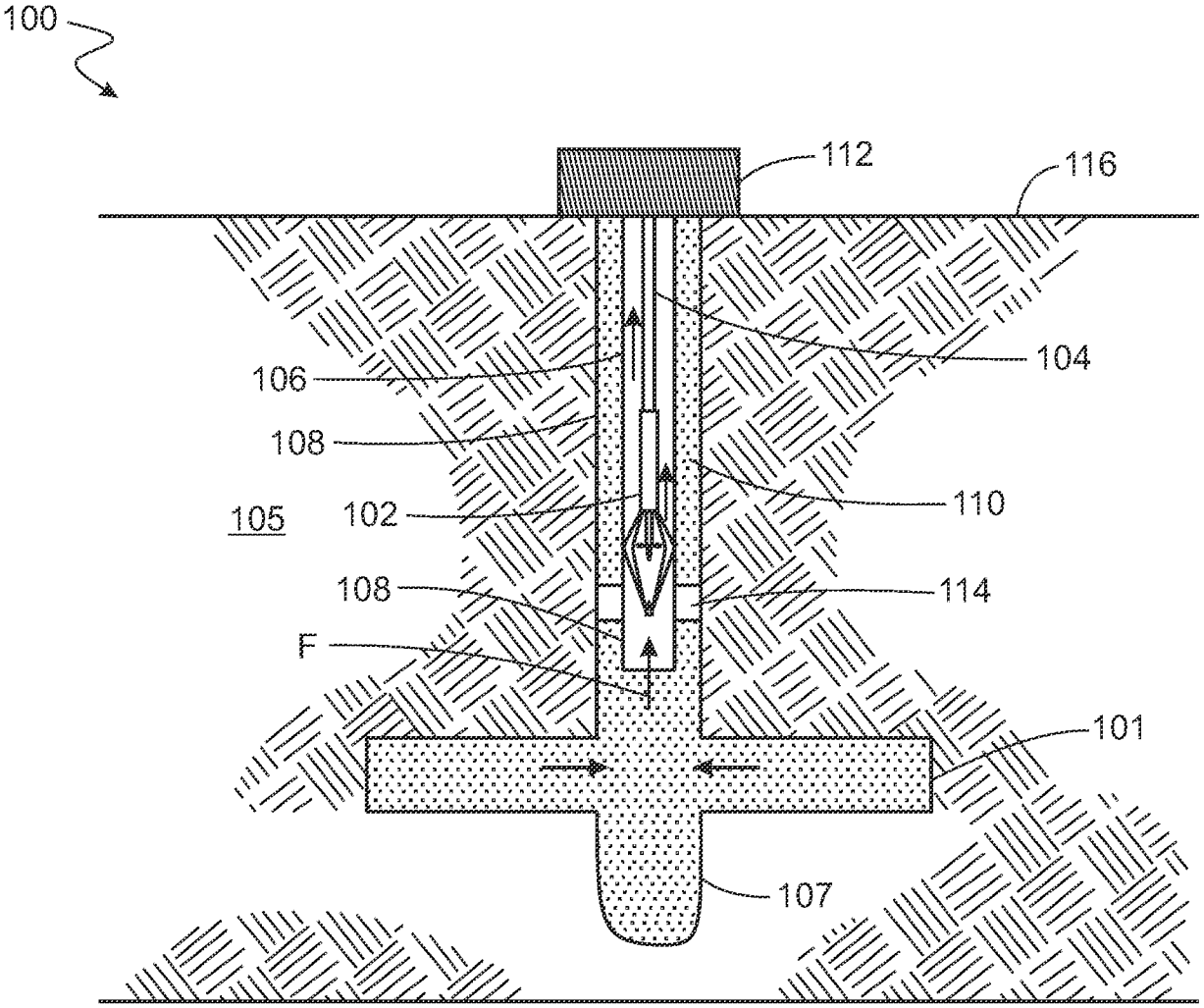
FIG. 1 is a schematic view, partially cross-sectional, of a wellbore assembly disposed within a wellbore.

FIG. 1 shows a wellbore assembly 100 containing a production string 106 that is disposed within a wellbore 108 (e.g., a vertical or non-vertical production wellbore). The wellbore 108 is formed in a geologic formation 105. The geologic formation 105 can include a hydrocarbon reservoir 101 from which hydrocarbons can be extracted. The wellbore 108 extends from a surface 116 (e.g., a terranean surface of the wellbore) to at least the reservoir 101. The wellbore 108 can have a rat hole 107 that is about 1.5 times a length extending from the bottom of the logging tool to the last sensor of the logging tool allow the tool to move across the reservoir 101 to log the entire reservoir 101. The wellbore 108 can includes a casing that is cemented on the wellbore 108. The production string 106 can include one or more isolation packers 114 to isolate the production zone or reservoir 101 from an annulus 110 uphole of the packers 114. A wellbore fluid "F" (e.g., hydrocarbons, water, or a mixture of hydrocarbons and water) flows from the reservoir 101 up the production string 106 to the surface 116 of the wellbore 108. The production string can be attached to a wellhead 112 or another similar surface equipment.

The wellbore assembly 100 includes a production logging tool 102 (PLT) and a wellbore string 104 attached to the PLT 102. As further described in detail below with respect to FIGS. 2 and 3, the PLT 102 is connected to a surface computer that controls a cleaning assembly of the PLT 102 to clean the PLT 102 in-situ, without having to retrieve the PLT 102 from the wellbore 108. For example, the wellhead 112 can include or be connected to one or more computers that transmit and receive information to and from the PLT 102 to clean the PLT 102.

Figure 2:
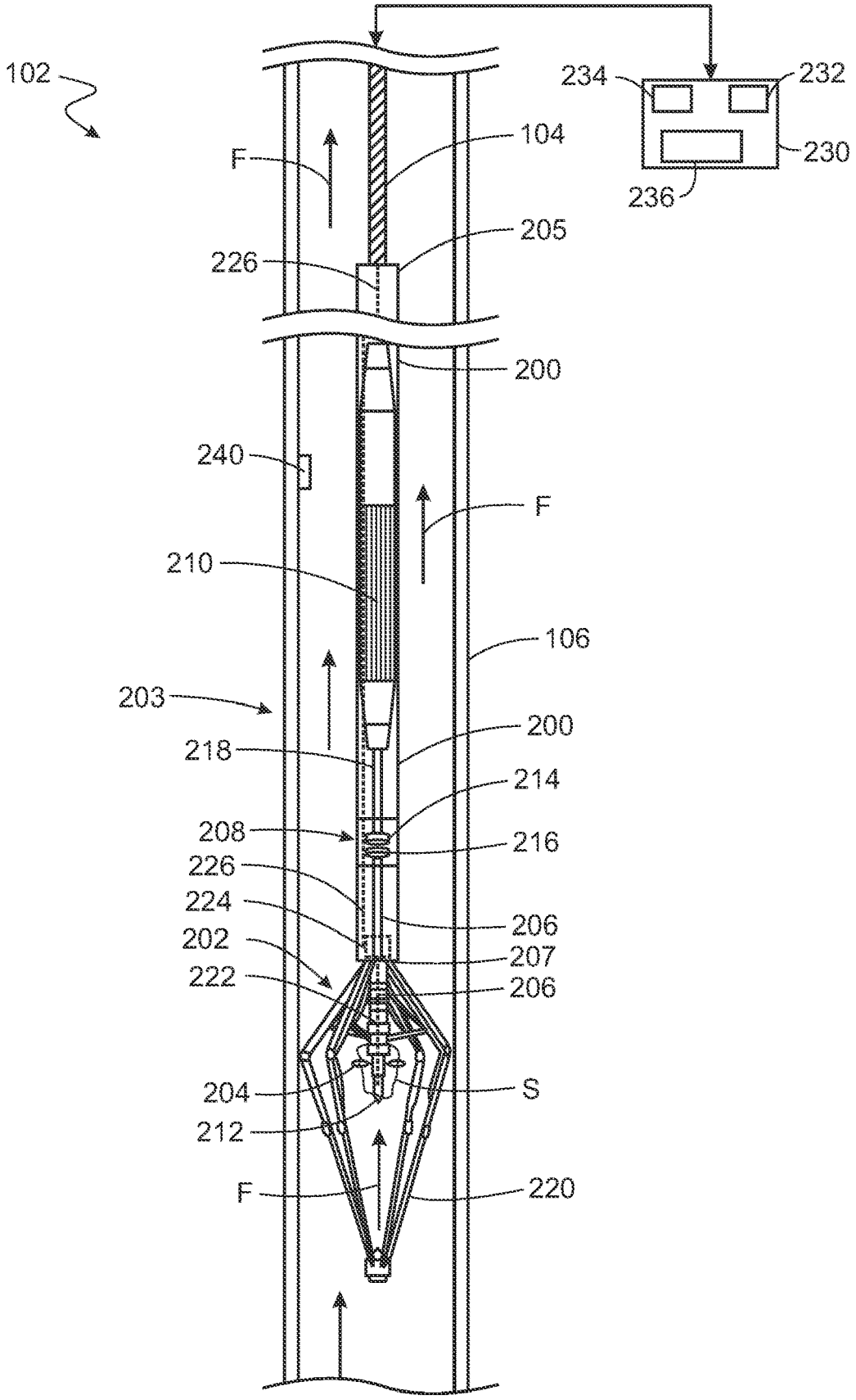
FIGS. 2-3 are front schematic views, partially cross-sectional, of sequential steps of cleaning a spinner of the wellbore assembly in FIG. 1.

Referring now to FIG. 2, the PLT 102 includes a housing 200, a flowmeter assembly 202, and a cleaning assembly 203. The housing 200 has a first end 205 attached to the wellbore string 104 (e.g., a wireline, a slickline, a tubing string, or a tractor) and a second end 207 attached to the flowmeter assembly 202. The wellbore string 104 runs or lowers the PLT 102 within the production string 106 to perform logging operations.

The flowmeter assembly 202 has a spinner 204 (or multiple spinners) and a spinner shaft 206 that is fixed to a rear surface of the spinner 204. The spinner 204 can be a fullbore spinner and can be in the shape of, for example, a helical pinner, a vane spinner, or another type of spinner used in flowmeter measurements. The spinner shaft 206 extends from the spinner 204 into the housing 200. The spinner 204 is exposed to the production fluid "F" in the production string 106. The spinner shaft 206 is rotatably attached (e.g., through ball bearings) to the second end 207 of the housing 200 to allow free rotation of the shaft (and by extension the spinner 204).

The PLT 102 can also include a centralizer 220 attached to the second end 207 of the housing 200 with the spinner 204 caged within the centralizer 220. The PLT 102 can have other centralizers to help center the spinner 204 along the central axis of the production string 106.

The cleaning assembly 203 includes a heating element 212, a drive 210 (e.g., an electric motor), a clutch 208, and a controller 230 electrically coupled (e.g., operationally and communicatively coupled) to the drive 210 and the heating element 212. For example, the controller 230 can be coupled, through an electrical cable 226 electrically attached to the wireline 104, to the drive 210 and the heating element 212.

The heating element 212 can be an electric heating element such as a metal pin or coil. The heating element can be fixed to a front surface of the spinner 204 to rotate with the spinner 204. The heating element can be electrically coupled, through a rotatable electrical coupling 224 (e.g., an electrical slip ring), to the cable 226 that connects the controller 230 to the heating element 212. For example, the heating element 212 can have an electrical cable 222 that rotates with the spinner shaft 206 and that is electrically coupled to the rotatable electrical coupling 224. The heating element 212 can heat the spinner 204 and a volume or space surrounding the spinner 204 to remove sticky or viscous materials "S" (e.g., sticky oil, wax, mud, debris, etc.) from the spinner 204. The sticky materials can be heavy materials mixed with solid rock fragments and other borehole debris. The sticky obstructions can, if not removed, prevent the spinner from rotating as intended and can thus affect the readings of the flowmeter. Heating the surroundings of the spinner can be an effective way to remove sticky materials such as wax as well as asphaltenes.

The drive 210 can be an electric motor (e.g., an AC or DC motor) fixed to the housing and isolated from the fluid "F" in the production string 106. The drive 210 rotates a shaft 218 that is axially attached to a portion of the clutch 208 that engages the other portion of the clutch 208 attached to the spinner shaft 206.

The clutch 208 can be an electromagnetic clutch or another type of clutch such as a friction clutch or a diaphragm clutch. For example, the clutch 208 can be an electromagnetic clutch with a rotor 214 (e.g., a flywheel) attached to the drive shaft 218 and an armature 216 (e.g., a pressure plate attached to the spinner shaft 206. The clutch 208 can be activated upon activation of the drive 210. For example, the rotor 214 mechanically engages (e.g., locks), upon activation of the drive 210, the armature 216 to spin the spinner shaft 206. Similarly, the rotor 214 disengages (e.g., unlocks), upon deactivation of the drive 210, the armature 216 to allow free rotation of the spinner 204.

The electromagnetic clutch can be operated electrically but the torque transmitted mechanically. For example, activating the drive 210 includes supplying electricity to an electric winding or coil of the rotor 214. The electrical current in the winding creates an electromagnetic field to attract the armature 216 to the rotor 214 and allow the rotor 214 to interface with and engage the armature 216. In some implementations, the spinner shaft 206 can be coupled to a gearbox (not shown) that changes the rotational speed of the spinner 204. The drive 210 can rotate the spinner 204 at high speeds until the sticky materials "S" are removed from the spinner 204 and the shaft 206. Thus, the spinner 204 can be cleaned by using heat, centrifugal force, or both (i.e., heating while spinning).

The controller 230 (or controllers) can reside at the surface of the wellbore (e.g., at the wellhead, near the wellhead, or at a different location at the terranean surface of the wellbore). The controller 230 can include one or more processors 232 and one or more receivers 234. The controller 230 can be coupled to the PLT 102 and other downhole sensors 240 (e.g., sensors to measure pressure, temperature, flow rate, noise, phase composition, pH, water cut, gas fraction and capacitance, etc.) attached to the production string 106 or other equipment of the wellbore. The processor 232 can use the data from the sensors 240 and from the flowmeter assembly 202 to determine if there is an obstruction preventing the spinner 204 from rotating as intended. In some implementations, the information from the flowmeter 202 and the sensors 240 can be displayed (e.g., in a graphical interface 236 of the controller or separate from the controller) to an operator for the operator to decide if a cleaning operation should be performed.

In some implementations, the controller 230 can be disposed within the wellbore (e.g., at the PLT 102), with the processor disposed at the surface of the wellbore. In some implementations, the controller 230 can be implemented as a distributed computer system disposed partly at the surface and partly within the wellbore. The computer system can include one or more processors and a computer-readable medium storing instructions executable by the one or more processors to perform the operations described here. In some implementations, the controller 230 can be implemented as processing circuitry, firmware, software, or combinations of them. The controller 230 can transmit signals to the drive 210 and the heating element 212 in real-time or near real-time to clean the spinner 204. As used herein, the term "real-time" refers to transmitting or processing data without intentional delay given the processing limitations of a system, the time required to accurately obtain data, and the rate of change of the data. Although there may be some actual delays, the delays are generally imperceptible to a user.

The PLT 102 transmits the information collected by the flowmeter assembly 202 to the receiver 234. The information includes at least one fluid parameter of the production fluid "F" flowing past the PLT 102. For example, the flowmeter assembly 202 can transmit a signal to the receiver 234 that represents a rotational speed of the spinner 204. The PLT 102 can transmit other information to the receiver 234. For example, the PLT 102 can have other sensors that measure or sense temperature and pressure for reservoir fluid characterization, fluid velocity, fluid flow rate, and fluid hold-up (e.g., fluid volumetric fractions across the wellbore from measurements of density, resistivity, and capacitance). The PLT 102 can also have a gamma ray and casing collar locator for depth correlation of the PLT measurements with original open hole logs.

The processor 232 can include the receiver 234 or be separate from the receiver 234. The processor 232 receives the information (e.g., from the receiver) gathered by the PLT 102 and can determine or help an operator to determine if the spinner 204 should be cleaned. For example, the processor 232 compares the information to a fluid parameter threshold, determines whether at least one of a sensitivity or performance of the flowmeter assembly 202 is impaired or compromised, and transmits instructions to the controller 230 or an operator to activate at least one of the drive 210 (and by extension the clutch 208) or the heating element 212. The processor 232 can determine if the flowmeter assembly 202 is impaired using the readings of the flowmeter assembly 202 and other information, such as the information from the other sensors 240 in the wellbore, information from other sensors of the PLT 102, and information including wellbore history, fluid properties, and flow performance. In some implementations, the processor 232 can determine if there is an obstruction based on a change of rotational speed of the spinner 204 (e.g., sudden changes in speed). For example, the processor can compare the changes in rotational speed to a threshold such as change of rotational speed threshold, and make determinations based on such comparison. If the processor 232 determines that the spinner 204 needs to be cleaned, the processor 232 can prompt the controller 230 to activate the drive 210 or the heating element 212 or both at the same time.

Figure 3:
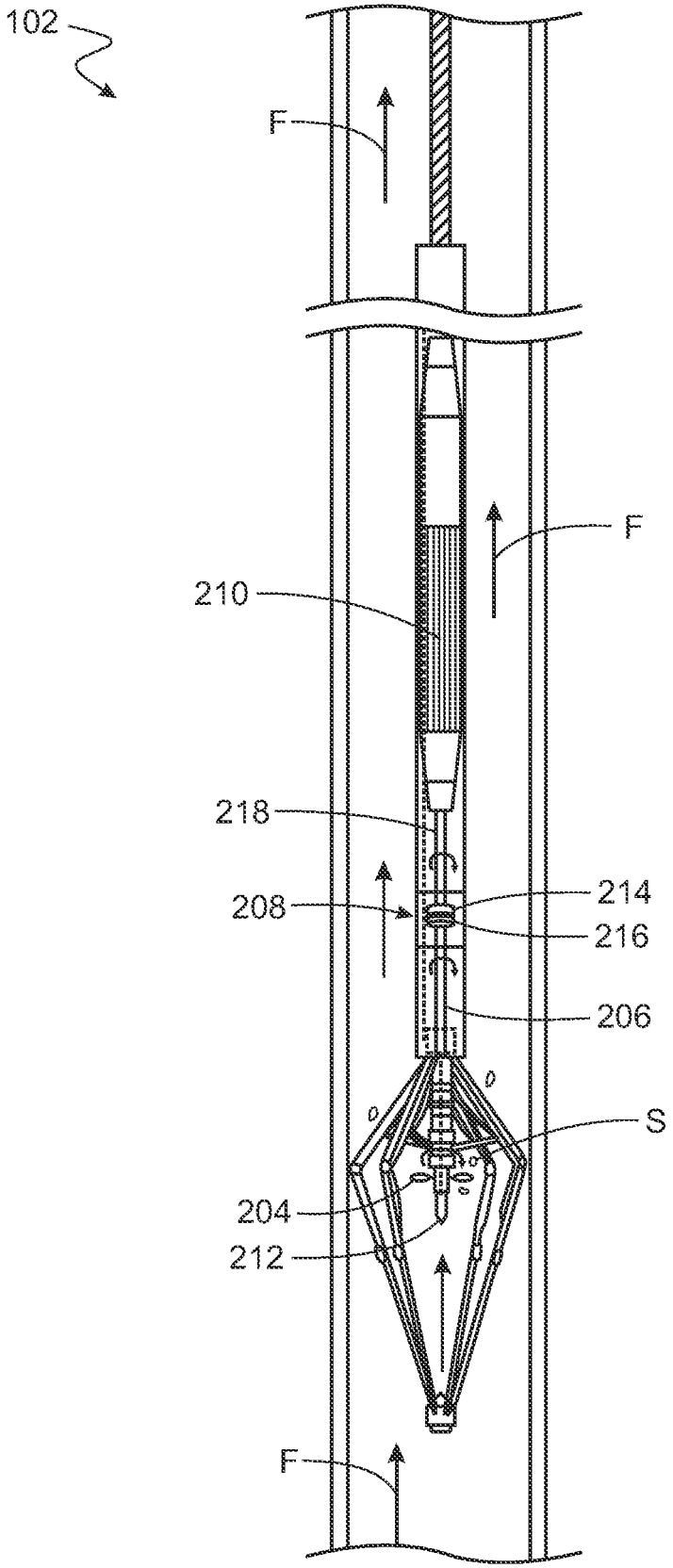

Referring now to FIG. 3, the rotor 214 is shown in contact and engaged with the armature 216. Once the rotor 214 is locked in with the armature 216, the drive 210 rotates its shaft 218 to rotate the spinner shaft 206 and thus rotate the spinner 204. The spinner 204 can be rotated at a high speed to increase the centrifugal force of the spinner blades and remove the sticky material "S" from the spinner 204. Additionally, the heating element 212 can be activated to heat the sticky material "S" or the spinner 204 or both to more quickly remove the material "S." With the sticky martial "S" removed, the PLT 102 can resume its logging operation.

Figure 4:
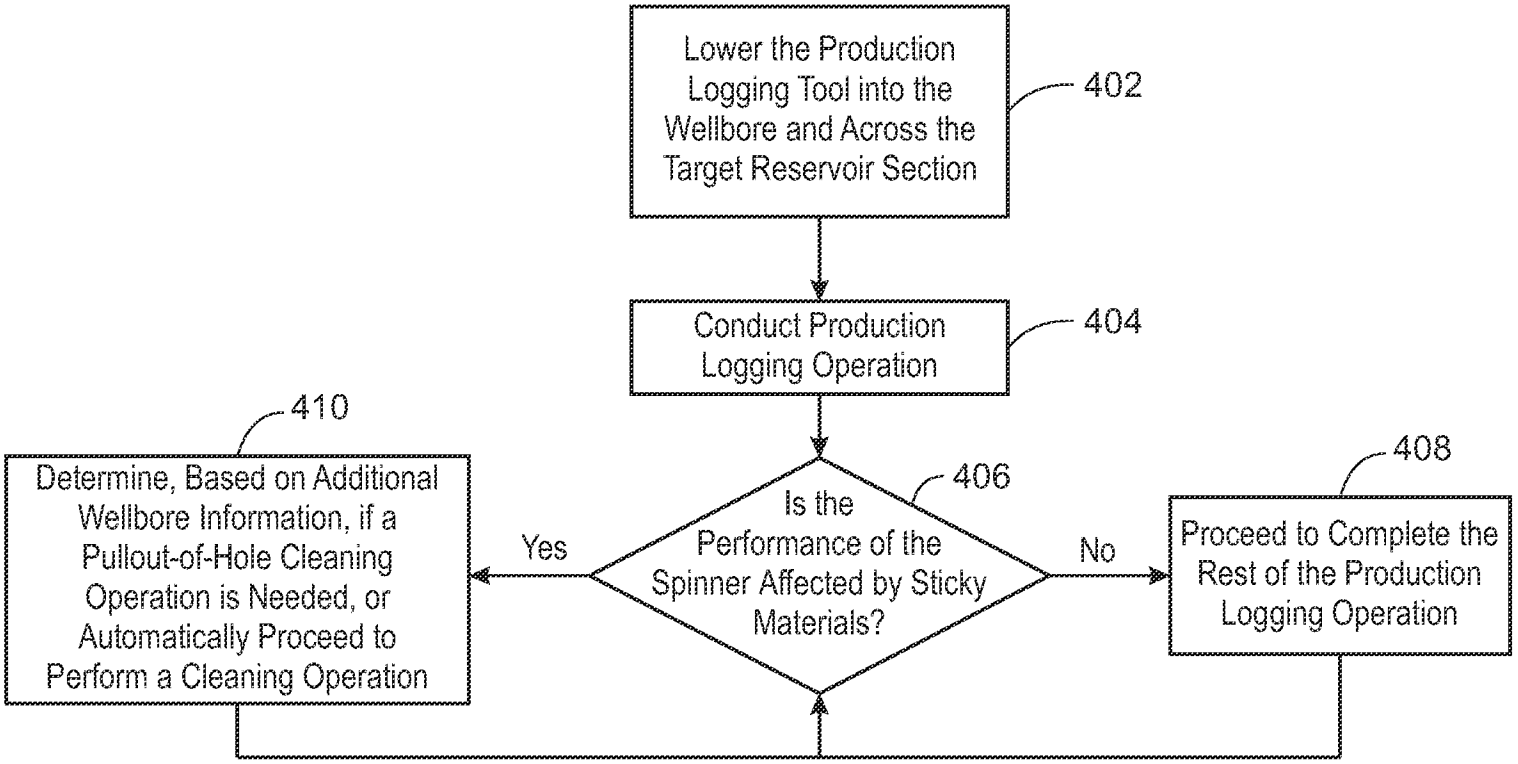
FIG. 4 is a decision block diagram of a process of cleaning a production logging tool.

FIG. 4 shows a decision flow diagram illustrating a process used to determine if the spinner should be cleaned. In the first block 402, the logging tool is lowered within the production string into the wellbore. The production string can be lowered into a rat hole across the target reservoir section to log the entire reservoir. In the second block 404, a first downhole logging run can be performed by lowering the tool to just below the target formation while gathering fluid information using the flowmeter. In some implementations, before the first logging operation is performed, the heater and the drive can be activated to clean the spinners or prevent any wellbore material from sticking to the spinner as the tool is being lowered within the wellbore. In the third block 406, it is determined if the performance of the spinner is affected by sticky materials. This can be determined by determining if the rotational speed of the spinner is below a threshold or if the spinner is otherwise being prevented from rotating normally. In the fourth block, if the surface reading of downhole measurement is normal, the tool continues logging (e.g., for three runs) until the job is completed. The system can continue to determine if the performance of the spinner is below a threshold during each run. In block 412, if the surface reading of downhole measurement indicates that the spinner is influenced by stick materials, the system can help an operator make a decision of whether to turn on the heater/motor, or the system can automatically turn on the heater/motor to conduct in situ self-cleaning. Once the cleaning operation is performed, if surface reading indicates that the performance of the pinner is restored, the system can continue logging until the job is completed. The cleaning operation can be selectively performed multiple times as needed.

Figure 5:
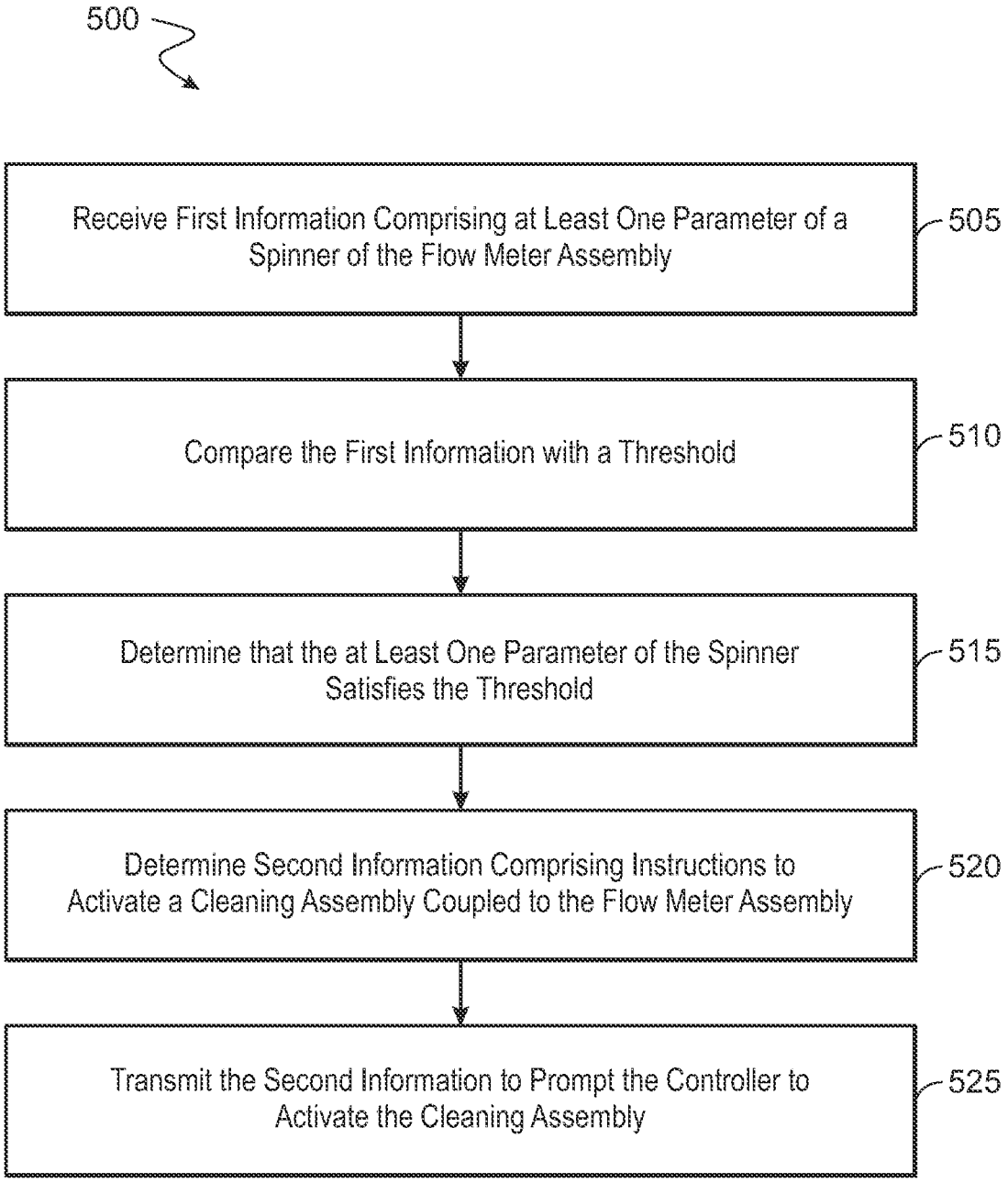
FIG. 5 is a flow chart of a method of cleaning a production logging tool.

FIG. 5 shows a flow chart of an example method 500 of cleaning a production logging tool (e.g., the PLT 102 of FIGS. 1-3). The method includes receiving, by a processing device (e.g., the processor 232 of FIG. 2) and from a flowmeter assembly communicatively coupled to the processing device, first information including at least one parameter of a spinner of the flowmeter assembly (505). The method also includes comparing, by the processing device, the first information with a threshold (510). The method also includes determining, by the processing device and based on the comparison, that the at least one parameter of the spinner satisfies the threshold (515). The method also includes determining, by the processing device and based at least on the determination that at least one parameter of the spinner satisfies the threshold, second information comprising instructions to activate a cleaning assembly coupled to the flowmeter assembly (520). The method also includes transmitting, by the processing device to a controller, the second information to prompt the controller to activate the cleaning assembly (525).

Figure 6:
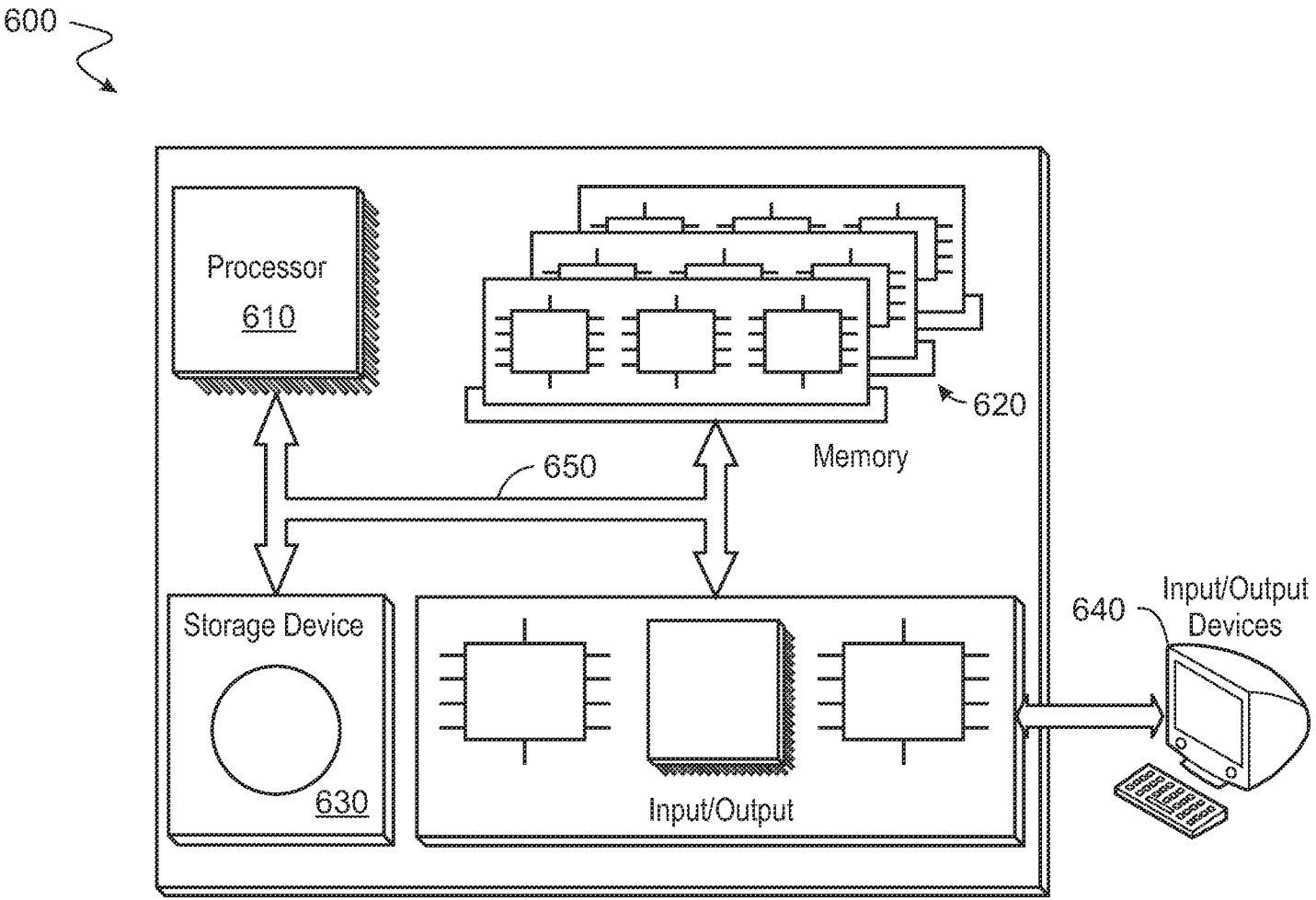
FIG. 6 is a schematic illustration of an example control system or controller according to implementations of the present disclosure.

FIG. 6 is a schematic illustration of an example control system or controller for a production logging tool according to the present disclosure. For example, the controller 600 may include or be part of the controller 230 shown in FIG. 2. The controller 600 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 600 includes a processor 610, a memory 620, a storage device 630, and an input/output device 640. Each of the components 610, 620, 630, and 640 are interconnected using a system bus 650. The processor 610 is capable of processing instructions for execution within the controller 600. The processor may be designed using any of a number of architectures. For example, the processor 610 may be a CISC (Complex Instruction Set Computers) processor, a RISC (Reduced Instruction Set Computer) processor, or a MISC (Minimal Instruction Set Computer) processor.

In one implementation, the processor 610 is a single-threaded processor. In another implementation, the processor 610 is a multi-threaded processor. The processor 610 is capable of processing instructions stored in the memory 620 or on the storage device 630 to display graphical information for a user interface on the input/output device 640.

The memory 620 stores information within the controller 600. In one implementation, the memory 620 is a computer-readable medium. In one implementation, the memory 620 is a volatile memory unit. In another implementation, the memory 620 is a non-volatile memory unit.

The storage device 630 is capable of providing mass storage for the controller 600. In one implementation, the storage device 630 is a computer-readable medium. In various different implementations, the storage device 630 may be a floppy disk device, a hard disk device, an optical disk device, or a tape device.

The input/output device 640 provides input/output operations for the controller 600. In one implementation, the input/output device 640 includes a keyboard and/or pointing device. In another implementation, the input/output device 640 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A production logging tool, comprising:

a housing comprising a first end attached to a wellbore string configured to run the housing along a production string disposed within a wellbore;

a flowmeter assembly comprising i) a spinner configured to be exposed, with the production logging tool within the production string, to fluid in the production string, and ii) a spinner shaft fixed to and extending from a rear surface of the spinner into the housing, the spinner shaft rotatably attached to a second end of the housing opposite the first end;

a heating element attached to the spinner;

a drive disposed within the housing;

a clutch comprising a rotor attached to the drive and an armature attached to the spinner shaft, the clutch configured to be activated with or after activation of the drive; and a controller operationally coupled to and configured to activate and deactivate at least one of the drive or the heating element to heat a volume around the spinner with the heating element or selectively spin the spinner with the drive.

2. The production logging tool of claim 1, further comprising a receiver communicatively coupled to and configured to receive, from the flowmeter assembly, information comprising at least one parameter of the fluid in the wellbore.

3. The production logging tool of claim 2, further comprising a processor communicatively coupled to the receiver and configured to:

receive the information from the receiver, compare the information to a fluid parameter threshold, determine, based on the comparison, that at least one of a sensitivity or performance of the flowmeter assembly is impaired, and transmit, based on the determination, instructions to the controller to activate at least one of the drive or the heating element.

4. The production logging tool of claim 2, wherein the heating element is configured to rotate with the spinner, the heating element electrically coupled, through an electrical slip ring, to a cable that electrically connects the controller to the heating element.

5. The production logging tool of claim 2, wherein the receiver resides at or near a terranean surface of the wellbore, and wherein the receiver is configured to transmit the information to an interface device configured to display the information for an operator to determine, based on the information, whether to activate at least one of the drive or the heating element.

6. The production logging tool of claim 1, wherein the heating element comprises an electric heating element fixed to a front surface of the spinner opposite the rear surface of the spinner to rotate with the spinner.

7. The production logging tool of claim 1, further comprising a centralizer attached to the second end of the housing, and wherein the spinner comprises a fullbore spinner caged within the centralizer.

8. The production logging tool of claim 1, wherein the rotor is configured to engage, upon activation of the drive, the armature to spin the spinner shaft with the drive and the rotor is configured to disengage, upon deactivation of the drive, the armature to allow free rotation of the spinner.

9. The production logging tool of claim 1, wherein the clutch comprises an electromagnetic clutch, and the controller is configured to activate the drive by transmitting electricity to an electrical winding of the rotor to generate a magnetic field and attract the armature toward the rotor to allow the rotor to engage the armature.

10. A wellbore tool, comprising:

a housing attached to a wellbore string configured to run the housing along a wellbore;

a flowmeter assembly rotatably coupled to the housing and comprising a first portion comprising a spinner and configured to be exposed, with the wellbore tool within the wellbore, to a wellbore fluid, and a second portion attached to the spinner and extending into the housing, the second portion isolated by the housing from the wellbore fluid;

a cleaning assembly coupled to the flowmeter assembly, the cleaning assembly configured to at least one of heat a space near the spinner or selectively rotate the spinner by engaging and rotating the second portion; and a controller operationally coupled to and configured to activate and deactivate the cleaning assembly to heat a volume around the spinner or axially rotate the spinner to remove obstructions from the spinner under centrifugal force of the spinner.

11. The wellbore tool of claim 10, wherein the cleaning assembly comprises:

a heating element fixed to the spinner;

a drive disposed within the housing and fluidly decoupled from the wellbore fluid; and a clutch residing between the drive and the flowmeter assembly, the clutch configured to be activated upon activation of the drive to allow the drive to engage and rotate the spinner;

wherein the controller is operationally coupled to and configured to activate and deactivate the drive or the heating element.

12. The wellbore tool of claim 11, wherein the heating element is configured to rotate with the spinner, the heating element electrically coupled, through a rotatable electrical connection, to a cable that electrically connects the controller to the heating element.

13. The wellbore tool of claim 11, wherein the clutch comprises an electromagnetic clutch comprising a rotor attached to the drive and an armature attached to the flowmeter assembly, the rotor configured to engage the armature to rotate the armature upon activation of the drive.

14. The wellbore tool of claim 10, further comprising a receiver communicatively coupled to and configured to receive, from the flowmeter assembly, information comprising at least one parameter of the fluid in the wellbore.

15. The wellbore tool of claim 14, further comprising a processor communicatively coupled to the receiver and configured to:

receive the information from the receiver, compare the information to a fluid parameter threshold, determine, based on the comparison, that at least one of a sensitivity or performance of the flowmeter assembly is impaired, and transmit, based on the determination, instructions to the controller to activate the cleaning assembly.

16. The wellbore tool of claim 10, further comprising a centralizer attached to a downhole end of the housing, and wherein the spinner comprises a full-bore spinner caged within the centralizer.

17. A method, comprising:

receiving, by a processing device and from a flowmeter assembly communicatively coupled to the processing device, first information comprising at least one parameter of a spinner of the flowmeter assembly;

comparing, by the processing device, the first information to a threshold;

determining, by the processing device and based on the comparison, that the at least one parameter of the spinner satisfies the threshold;

determining, by the processing device and based at least on the determination that at least one parameter of the spinner satisfies the threshold, second information comprising instructions to activate a cleaning assembly coupled to the flowmeter assembly; and transmitting, by the processing device to a controller, the second information; and activating a drive of the cleaning assembly with the controller as a function of receiving the second information by the controller to rotate the spinner.

18. The method of claim 17, wherein determining the second information comprises determining the second information based on wellbore history and third information received from one or more sensors disposed within the wellbore.

19. The method of claim 17, wherein the at least one parameter comprises a change of rotational speed of the spinner and the threshold comprises a change of rotational speed threshold, and determining that the at least one parameter of the spinner satisfies the threshold comprises determining that the change of rotational speed of the spinner is above the threshold.

20. The method of claim 17, wherein the cleaning assembly comprises:

a heating element fixed to the spinner; and a clutch residing between the drive and the flowmeter assembly, the drive disposed within a tube that houses at least part of the flowmeter assembly, the clutch configured to be activated upon activation of the drive to allow the drive to engage and rotate the spinner, and wherein transmitting the second information to the controller comprises transmitting the second information to prompt the controller to activate at least one of the heating element or the drive.

* * * * *